United States Patent [19]

Schiek et al.

[11] 4,178,570

[45] Dec. 11, 1979

[54] MICRO-SLOT-STRIPLINE PHASE SHIFTER

[75] Inventors: Burkhard Schiek; Jürgen Köhler, both of Halstenbek, Fed. Rep. of Germany

[73] Assignee: U.S. Philips Corporation, New York, N.Y.

[21] Appl. No.: 879,399

[22] Filed: Feb. 21, 1978

[51] Int. Cl.[2] ..... H01P 3/08; H01P 1/18

[52] U.S. Cl. ..... 333/161; 333/246

[58] Field of Search ..... 333/31 R, 31 A, 84 M, 333/97 R, 96, 156, 161, 238, 246

[56] References Cited

U.S. PATENT DOCUMENTS

| | | | |
|---|---|---|---|
| 3,688,225 | 8/1972 | Cohn | 333/84 R X |
| 4,085,391 | 4/1978 | Schiek et al. | 333/84 M X |

OTHER PUBLICATIONS

Schiek—"Hybrid Branchline Couplers—A Useful New Class of Directional Couplers" in Trans. on Microwave Theory and Techniques, vol. MTT22, No. 10, Oct. 1974, pp. 864–869.

*Primary Examiner*—Alfred E. Smith
*Assistant Examiner*—Marvin Nussbaum
*Attorney, Agent, or Firm*—Algy Tamoshunas

[57] ABSTRACT

A phase shifter having, on one surface of a substrate, a microstrip stub which is connected in parallel to a microstrip line and which is open at one end. Disposed below the stub is a slot which is short-circuited at a point below the open end of the stub, and which ends in an open circuit at the opposite end.

12 Claims, 6 Drawing Figures

MICRO-SLOT-STRIPLINE PHASE SHIFTER

The invention relates to a phase shifter comprising a substrate having a top and bottom surface, a microstrip line being provided on the top surface and a conductive base plate arrangement on the bottom surface.

Differential phase shifters for a fixed phase of, for example 45°, 90°, 180° using meander lines are known. With suitable dimensioning in stripline technique, such meander lines can be matched frequency independent. A $\lambda/4$ meander line and a $\frac{3}{4}\lambda$ reference line have, for example, at the output a phase difference of approximately 90° over a wide frequency range when their inputs are driven with the same phase.

If an attempt is made to realize such differential phase shifters in planar stripline technique, it is found that, owing to the different phase velocities of the even and odd modes, meanders cannot be matched over a broad frequency band. Moreover, it is difficult or impossible to realize tighter couplings in planar stripline technique.

It is an object of the invention to provide improved coupling ratios for the phase shifters specified in the preamble and to simplify matching.

This object is accomplished in that the phase shifter of the invention comprises a microstrip line and a microstrip stub connected electrically in parallel to the continuous line. The stub is open at the end not connected to the microstrip line and the phase shifter further includes a slotted line arranged in the base plate below the stub. The slotted line is short circuited in the region of the open end of the stub and its other end is open.

With this arrangement, any required propagation-time equalisation can be obtained in the simplest possible manner, while the effective coupling is markedly improved compared to known arrangements.

The invention will now be described in greater detail with reference to the accompanying drawing in which.

Figure 1:
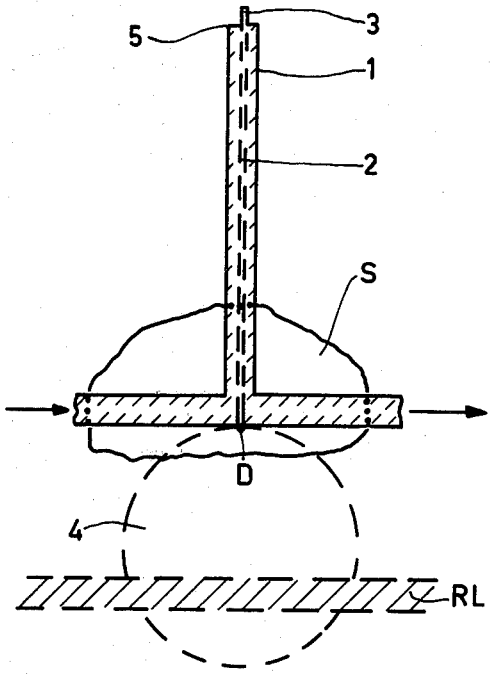
FIG. 1 shows a phase shifter of the invention.

The phase shifter shown in FIG. 1 comprises a microstrip stub (1) which is open at end (5), on the top surface of a substrate S and a microslot line (2) on the bottom surface of the substrate. The microslot line (2) which, for clarity's sake, is shown in an exaggerated manner, is then precisely below the microstrip (1) and ends at one end in a short circuit (3) and at the other end (point D) in an open end (4). Also here the required reference line RL can be implemented as a microstrip line.

The slotted line (2) may alternatively have a somewhat different length—shorter or longer—than the microstrip stub (1) in which it is enclosed, in order to compensate in a simple manner for, for example, the different phase velocities between the even and odd modes or to achieve more accurate matching. In addition, the arrangement shown in FIG. 1 has an effective coupling which is markedly better than in known meander-arrangements.

Figure 2:
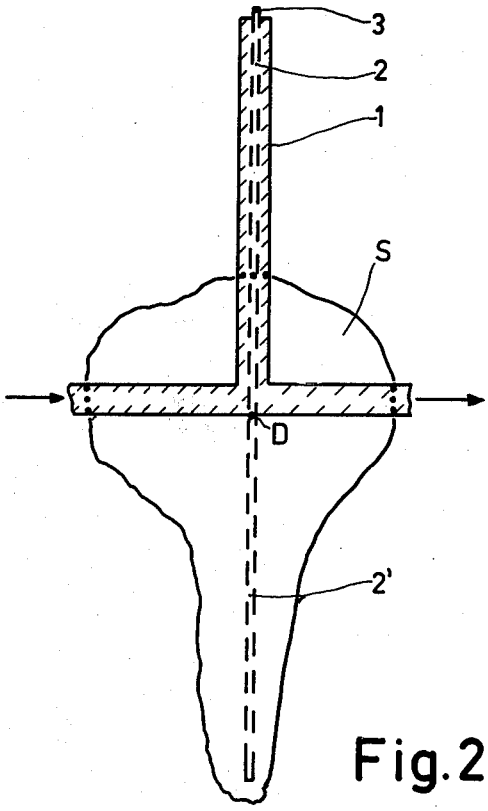
FIGS. 2 and 3 show modifications of the phase shifter in accordance with the invention.

As shown in FIG. 2, the slotted line (2') can be extended, forming its mirror image, through point D in the base. In a corresponding manner, the microstrip stub (1) or the slotted line (2') and the microslot stub (1) can also be extended mirror-inverted.

Figure 3:
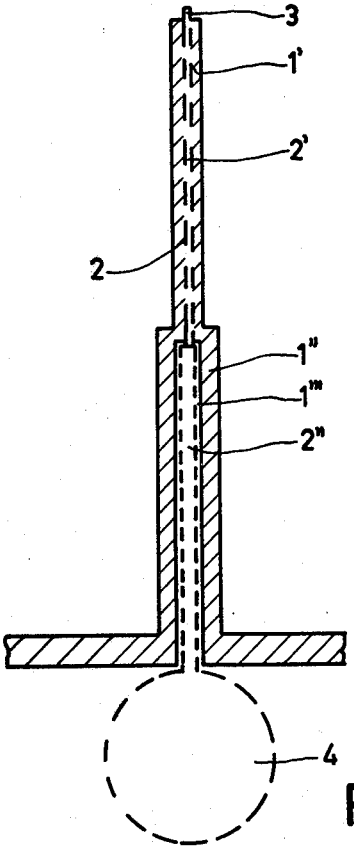

As shown in FIG. 3 the microstrip line can be formed from sections of different impedances 1' and 1'', which also applies to the slotted line 2 in a range 2'', the microstrip stub being partially separated by the gap 1''.

Figure 4:
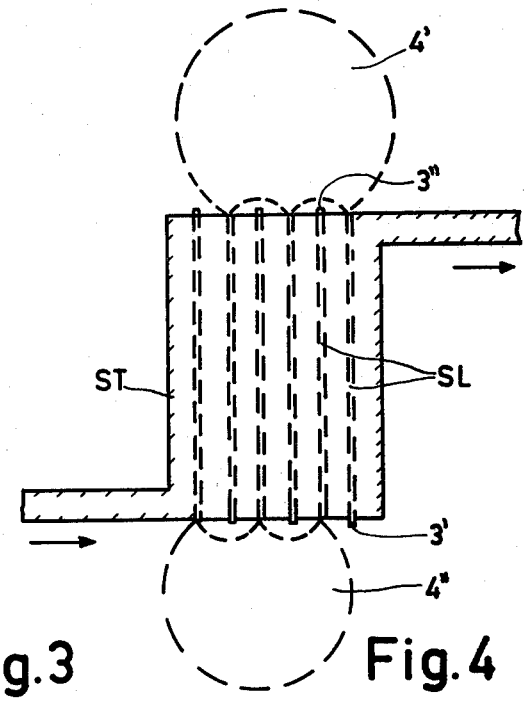
FIG. 4 shows a cascade arrangement in accordance with the invention.

As shown in FIG. 4 the arrangement can alternatively be cascaded, all stubs ST then being interconnected and the open end 4'' of the slotted lines SL being located below the stubs ST. The open ends 4', 4'' and short circuits 3', 3'' of the slotted lines SL alternate on each side.

Figure 5:
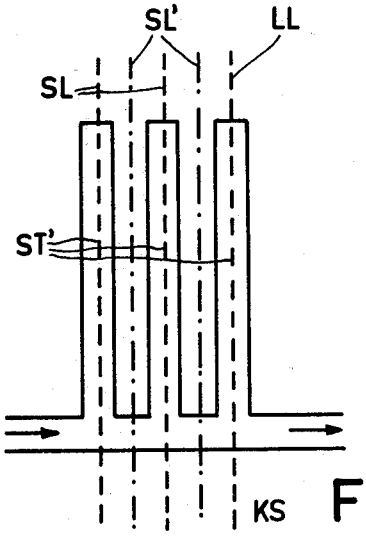
FIG. 5 shows a comb-shaped arrangement in accordance with the invention.
Figure 6:
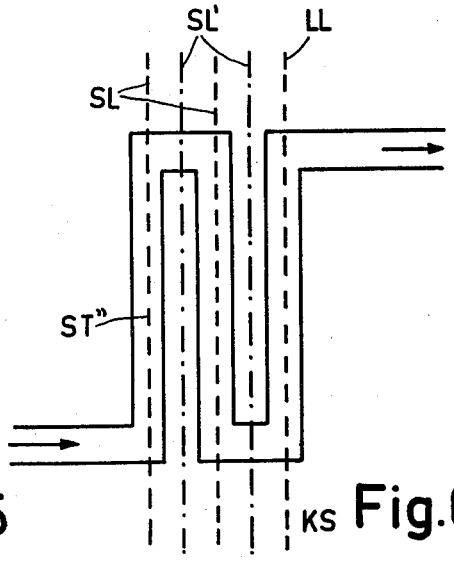
FIG. 6 shows a meander-shaped cascade arrangement in accordance with the invention.

The stubs ST' or ST'' can be arranged in the form of a comb, (FIG. 5) or in the form of a meander (FIG. 6). The slotted lines SL can then be arranged in a corresponding manner below the stubs, optionally in such a manner that the open ends LL are arranged on one side and the short circuits KS on the other side. The ends of the slotted lines SL may be interconnected in a meander-like manner. In addition, slotted lines SL' may be provided on a substrate between the stubs ST' or ST''.

We claim:

1. A phase shifter comprising a substrate having a top and a bottom surface, a microstrip line provided on the top surface, a conductive base plate arranged on the bottom surface, a microstrip stub arranged on the top surface and having one end connected electrically in parallel to the microstrip line, said stub being open at the end not connected to the microstrip line and a slotted line arranged in the base plate below the stub, one end of said slotted line being short circuited in the region of the open end of the stub and the other end of said slotted line being open.

2. The phase shifter as claimed in claim 1 wherein the slotted line is longer than the microstrip stub.

3. The phase shifter as claimed in claim 1 wherein the slotted line is shorter than the microstrip stub.

4. The phase shifter as claimed in claim 1 or any of the preceding claims wherein the slotted line is extended mirror-inverted beyond the point in the base opposite the point at which said stub is connected to said microstrip line.

5. The phase shifter as claimed in claim 1 wherein the stub and the slotted line each includes sections of different impedances.

6. The phase shifter as claimed in claim 5 wherein a portion of the microstrip stub has a longitudinally extending gap.

7. The phase shifter as claimed in claim 1 including a plurality of said stubs and a plurality of said slotted lines disposed below the stubs.

8. A phase shifter as claimed in claim 7 wherein the open ends and short circuits of said slotted lines alternate on each side of said microstrip line.

9. A phase shifter as claimed in claim 7 or 8 wherein the slotted lines are interconnected in a meander-like manner.

10. The phase shifter as claimed in claim 7 wherein the stubs are arranged in a comb-like manner.

11. The phase shifter as claimed in claim 7 wherein the stubs are arranged in a meander-like manner.

12. The phase shifter as claimed in claim 10 or 11 including addition slotted lines provided between the stubs on the substrate.

* * * * *